US007147286B2

(12) United States Patent
Cesaroni et al.

(10) Patent No.: US 7,147,286 B2
(45) Date of Patent: Dec. 12, 2006

(54) VERSATILE CHAIR

(75) Inventors: William Cesaroni, Glenview, IL (US); Shawn Barrett, Des Plaines, IL (US); Curtis Cruver, Elmhurst, IL (US); Joseph Keitel, Muscatine, IA (US); James Groulx, Muscatine, IA (US); Randall E. Green, Muscatine, IA (US); Ronald Lewis, Finley, TN (US)

(73) Assignee: HNI Technologies Inc., Muscatine, IA (US)

( * ) Notice: Subject to any disclaimer, the term of this patent is extended or adjusted under 35 U.S.C. 154(b) by 170 days.

(21) Appl. No.: 10/856,164

(22) Filed: May 28, 2004

(65) Prior Publication Data

US 2005/0264060 A1 Dec. 1, 2005

(51) Int. Cl.
*A47C 7/60* (2006.01)

(52) U.S. Cl. ..... 297/301.1; 297/239; 297/331; 297/411.44

(58) Field of Classification Search ..... 297/239, 297/291, 294, 296, 297, 299, 301.1, 301.5, 297/331, 338, 411.44, 55
See application file for complete search history.

(56) References Cited

U.S. PATENT DOCUMENTS 3,982,785 A * 9/1976 Ambasz ..... 297/160
4,084,850 A * 4/1978 Ambasz ..... 297/317
5,524,966 A * 6/1996 Piretti ..... 297/301.3
5,568,961 A 10/1996 Colasanti
5,580,127 A 12/1996 Piretti
D418,322 S 1/2000 Hock
6,116,686 A 9/2000 Luo
6,149,236 A 11/2000 Brauning
D440,784 S 4/2001 Ambasz
D446,661 S 8/2001 Ambasz
D449,938 S 11/2001 Vanderiet et al.
D452,619 S 1/2002 Piretti
D456,164 S 4/2002 Vanderiet et al.
D457,344 S 5/2002 Grosfillex
D461,660 S 8/2002 Koepke et al.
6,481,789 B1 * 11/2002 Ambasz ..... 297/55
D469,971 S 2/2003 Piretti
D471,373 S 3/2003 Starczewski et al.
D472,065 S 3/2003 Tseng
D475,544 S 6/2003 Chadwick et al.
6,588,844 B1 * 7/2003 Stenzel ..... 297/300.2
6,742,839 B1 * 6/2004 Piretti ..... 297/239
6,755,468 B1 * 6/2004 Pan ..... 297/335

* cited by examiner

*Primary Examiner*—Laurie K. Cranmer
(74) *Attorney, Agent, or Firm*—Faegre & Benson LLP

(57) ABSTRACT

A versatile chair having a back assembly, a seat assembly and a leg assembly. Two brackets are formed on the leg assembly and create an axis of rotation for the back assembly and for the seat assembly independent of the back assembly. The back assembly rotates due to a user's weight. The seat assembly is rotated manually. The chair is stackable and nestable with identically structured chairs. A tension system is aligned on an oblique axis to bias the back assembly to an upright position. The tension system is mounted within front legs of the leg assembly.

31 Claims, 7 Drawing Sheets

VERSATILE CHAIR

CROSS REFERENCE TO RELATED APPLICATIONS

This application is a combination in part of Application No. 29/183,552 entitled: Chair, filed on Jun. 13, 2003. Priority of all common subject matter is claimed.

BACKGROUND OF THE INVENTION

Statement Regarding Federally Sponsored Research

Not applicable.

1. Field of the Invention

The present invention relates to a versatile chair and more particularly to a versatile chair that may be nested or stacked, and having a flexing back. The chair is comfortable, strong and relatively inexpensive.

2. Description of the Related Art

The changing nature of the workplace has brought forth the need for flexibility in space usage. For example, instead of dedicated rooms for different functions, many companies now use the one large, open space alternatively for such activities as computer training, conferences, small group teaming for facilitating interaction, as classrooms, for panel discussions and even as dining facilities. To allow this flexibility, new furniture concepts are needed to provide the flexibility being sought.

BRIEF SUMMARY OF THE INVENTION

What is described here is a versatile chair comprising a front pair of legs, a rear pair of legs connected to the front pair of legs, a seat assembly mounted to both pairs of legs, a back assembly pivotally mounted to the pairs of legs, a pair of biasing elements positioned within the front pair of legs and attached to the back assembly to allow the back assembly to pivot without disturbing the seat assembly.

There are a number of advantages, features and objects achieved with the present invention which are believed not to be available in earlier related devices. More particularly, the chair of the present invention is multi-purpose so as to accommodate a range of work modes and yet is strong and comfortable. Other features of the chair of the present invention include high reliability and relatively low expense. Further objects of the chair of the present invention is that it may be nested or stacked as the chairs are easily movable and highly suitable for storage. Comfort is enhanced by having the back assembly of the chair capable of flexing while the seat assembly is maintained stationary.

A more complete understanding of the present invention and other objects, advantages and features thereof will be gained from a consideration of the following description of preferred embodiments read in conjunction with the accompanying drawing provided herein. The preferred embodiments represent examples of the invention which is described here in compliance with Title 35 U.S.C. section 112 (first paragraph), but the invention itself is defined by the attached claims.

DETAILED DESCRIPTION OF A PREFERRED EMBODIMENT OF THE INVENTION

Figure 1:
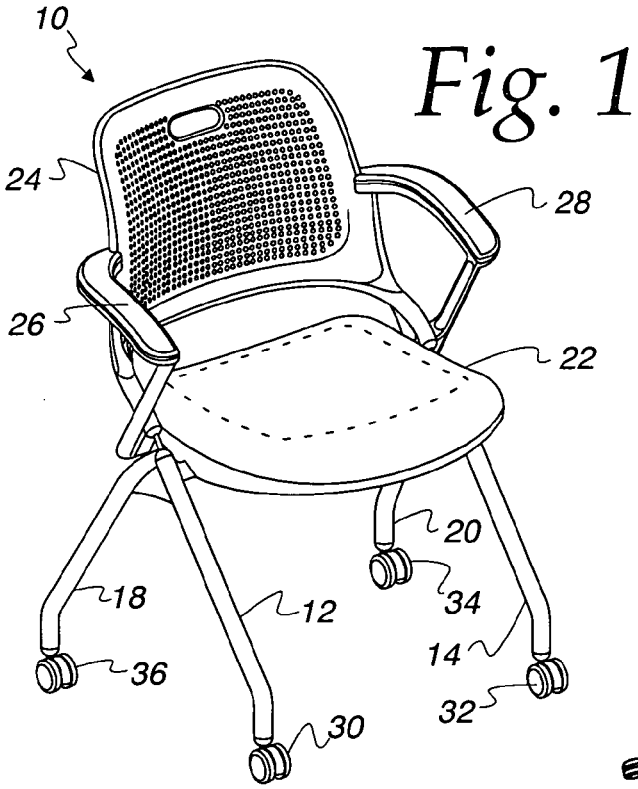
FIG. 1 is a front isometric view of the chair disclosed herein.
Figure 2:
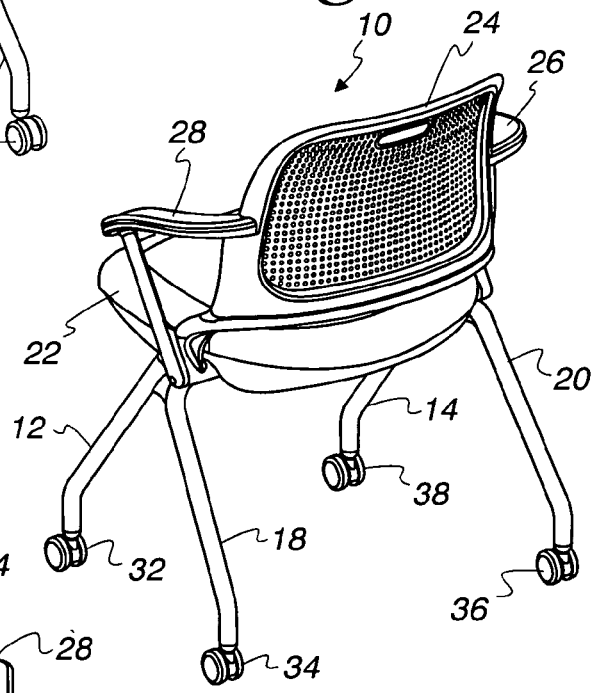
FIG. 2 is a rear isometric view of the chair shown in FIG. 1.

While the present invention is open to various modifications and alternative constructions, the preferred embodiments shown in the various figures of the drawing will be described herein in detail. It is understood, however, that there is no intention to limit the invention to the particular embodiments, forms or examples which are disclosed here. On the contrary, the intention is to cover all modifications, equivalent structures and methods, and alternative constructions falling within the spirit and scope of the invention as expressed in the appended claims, pursuant to Title 35 U.S.C. section 112 (second paragraph).

The simplicity of construction may be understood by reference first to FIGS. 1–7. A chair 10 is illustrated including a leg assembly constructed of a pair of front legs 12, 14 and a pair of rear legs 18, 20. The chair includes a seat assembly 22, a back assembly 24 and a pair of arms 26, 28. Four wheels or casters 30, 32, 34, 36 are part of the leg assembly.

Figure 7:
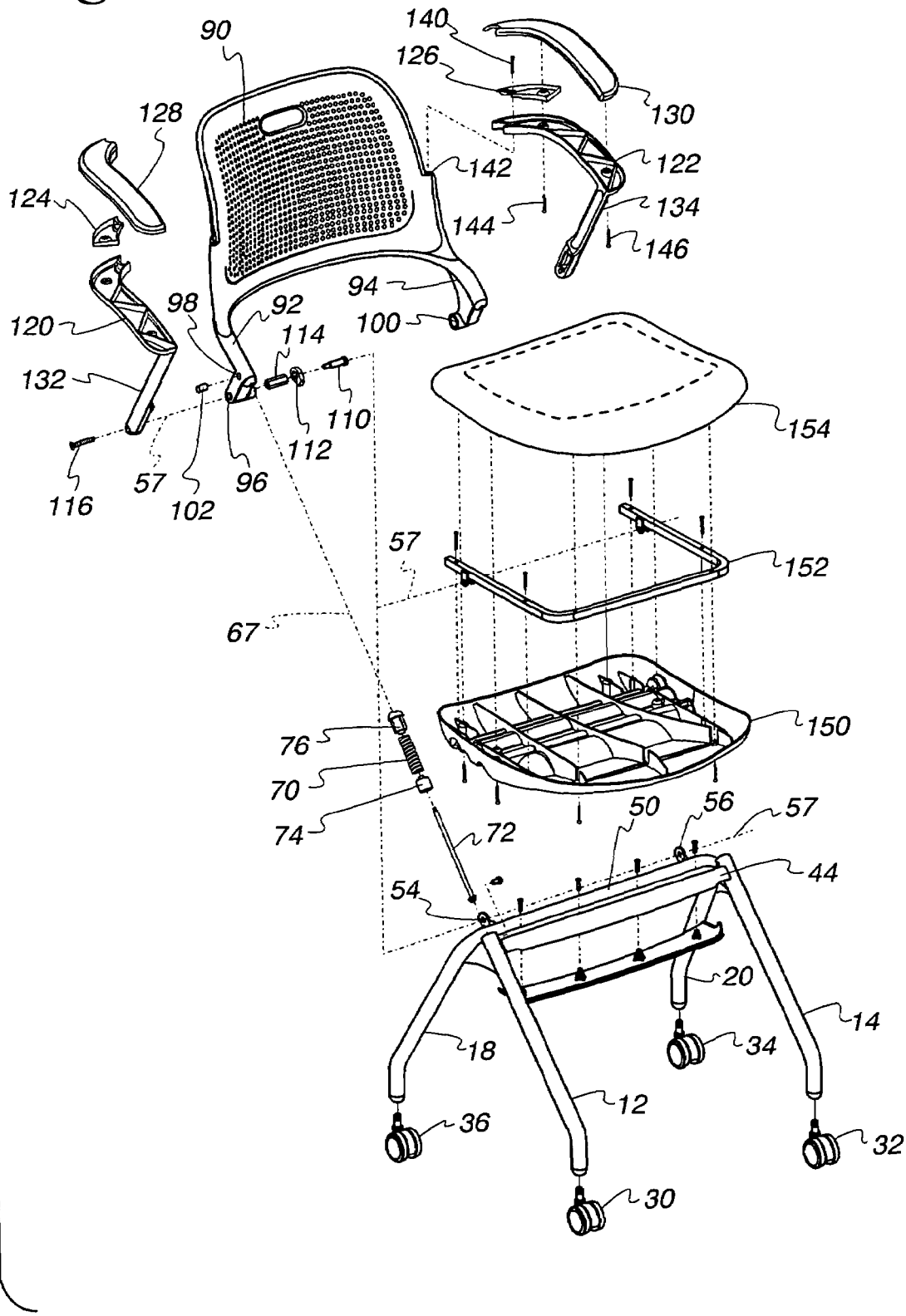
FIG. 7 is a exploded front isometric view of the chair shown in FIGS. 1–6.
Figure 8:
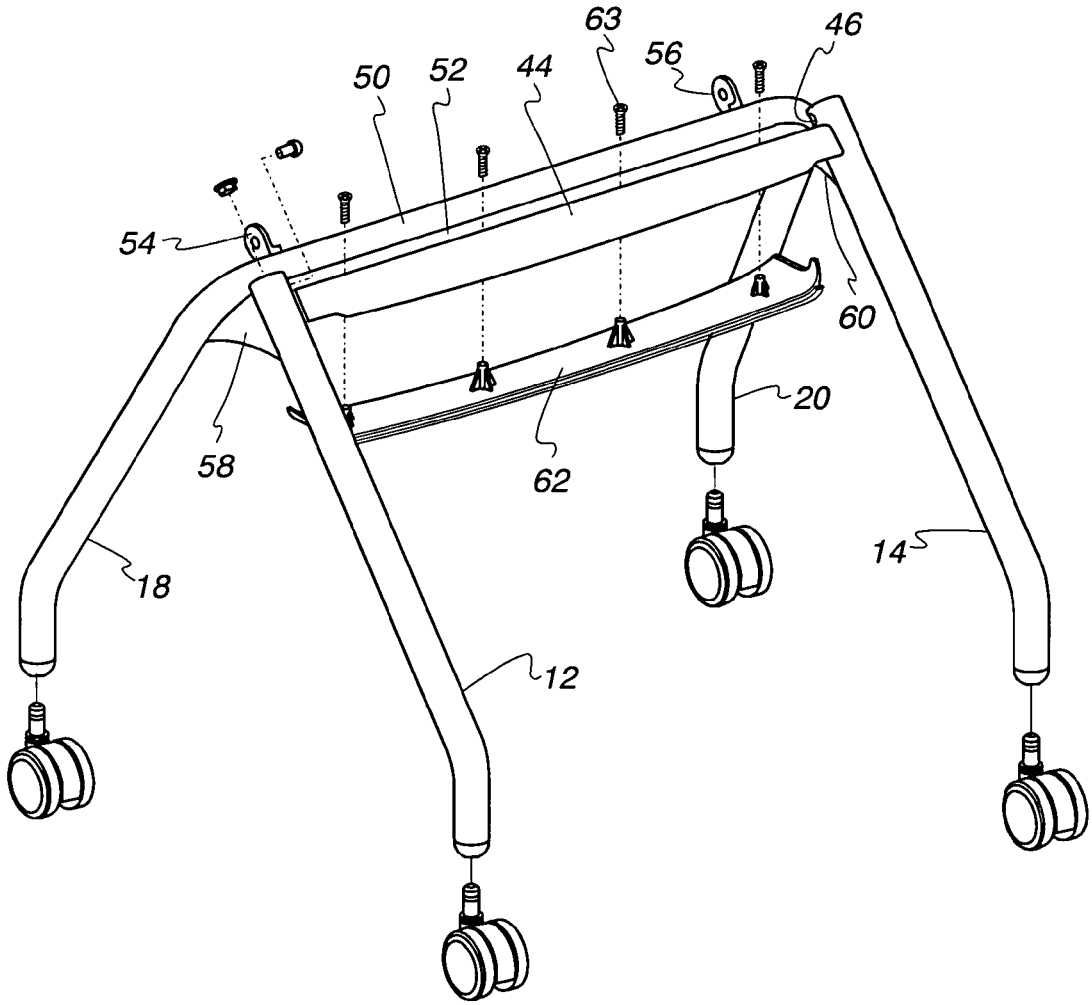
FIG. 8 is an enlarged, exploded isometric view of a leg assembly of the chair shown in FIGS. 1–7.

The pair of front legs 12, 14 are each formed of a length of tubular steel and are connected by a cross bar 44, FIGS. 7 and 8 which is welded to the upper end portions of each of the front legs. Above the cross bar on each front leg is a hole, such as the hole 46. The bar also supports the seat assembly.

The pair of rear legs 18, 20 are formed by a continuous bent tubular steel tube. The legs 18, 20 are end portions and are integral with a middle portion 50 which extends generally parallel to the cross bar 44 but spaced slightly away to leave a gap 52. Two eyelet brackets 54, 56 are welded to the middle portion 50 and help form a first axis of rotation 57. Connected to both pairs of legs are side flanges 58, 60. A bottom panel 62 is provided to cover the under side of the cross bar 44 and the tube middle portion 50 and is secured by fasteners such as the screw 63.

The eyelet brackets include fastener openings 64, 66 which are aligned to form the first axis of rotation 57. The first axis represent a pivoting axis for the back assembly and a rotational axis for the seat assembly.

Figure 9:
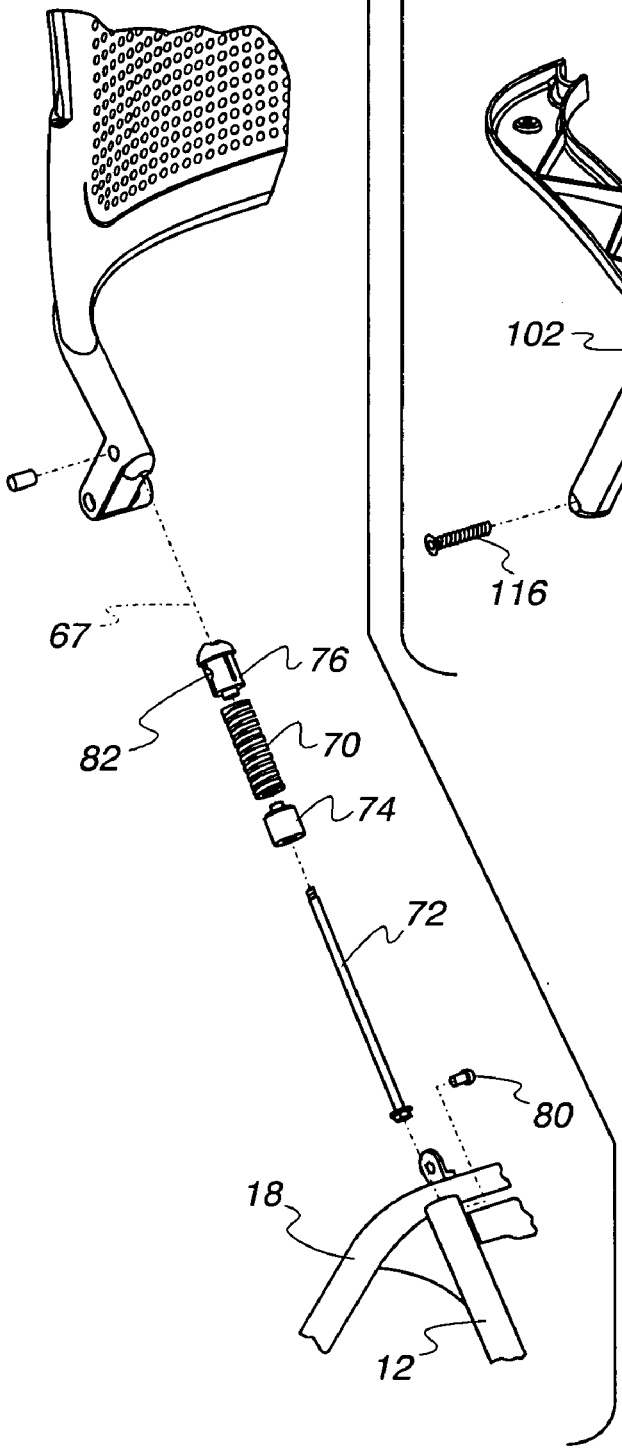
FIG. 9 is an enlarged, exploded isometric view of components to bias a back assembly of the chair to an upright position.

Located within each hollow, tubular leg and defining a second or tension axis 67 is a compression spring, a rod, a spring guide and a frame cap, such as the spring 70, FIGS. 7 and 9, the rod 72, the spring guide 74 and the frame cap 76 in the leg 12. Each frame cap is held in place by a set screw, such as the set screw 80, which engages the frame cap through a hole 82 in the cap and the hole 46, FIG. 8, in the front legs. An identical axis is coincident with the other front leg 14 and an identical set of components is placed within the leg 14.

Figure 10:
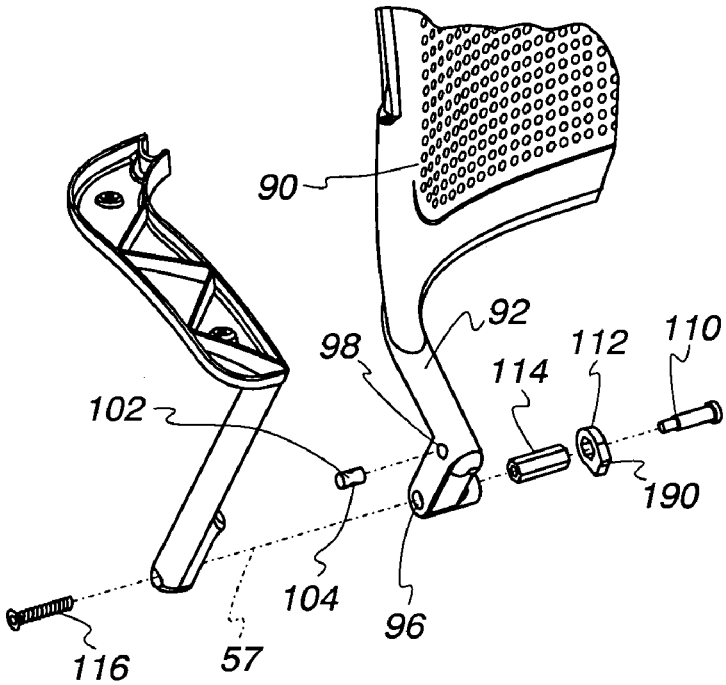
FIG. 10 is an enlarged, exploded isometric view of connector components of the chair for rotatably mounting the back assembly.

The back assembly includes a perforated curved back support 90, FIGS. 7 and 10, two side posts 92, 94 each with two laterally extending holes, of which only the holes 96, 98, 100 are shown, and a dowel 102 having a threaded opening 104 formed through its middle portion.

The holes 96, 100 help define the first or rotational axis 57 of the back assembly relative to the seat assembly. The holes 96, 100 also receive connectors and motion limiting devices. For example, the hole 96 receives a pivot bolt 110, FIG. 10, a motion limit washer 112, a bushing 114 to which the limit washer is mounted, and a threaded fastener 116. The oppositely, located hole 100 receives another set of the same components.

Each of the two arms 26, 28 includes a base 120, 122, FIG. 7, a panel 124, 126, a pad 128, 130 and a mounting post 132, 134. The armrests are attached to the back support by a fastener, such as the fastener 140 engaged in a threaded opening, such as the opening 142. The mounting posts 132, 134 are attached to the eyelet brackets 54, 56 by the same bolt 110 and fastener 116 that connect the back support go to the eyelet brackets. The pads 128, 130 are connected to the bases 120, 122 by fasteners such as the screws 144, 146.

Figure 11:
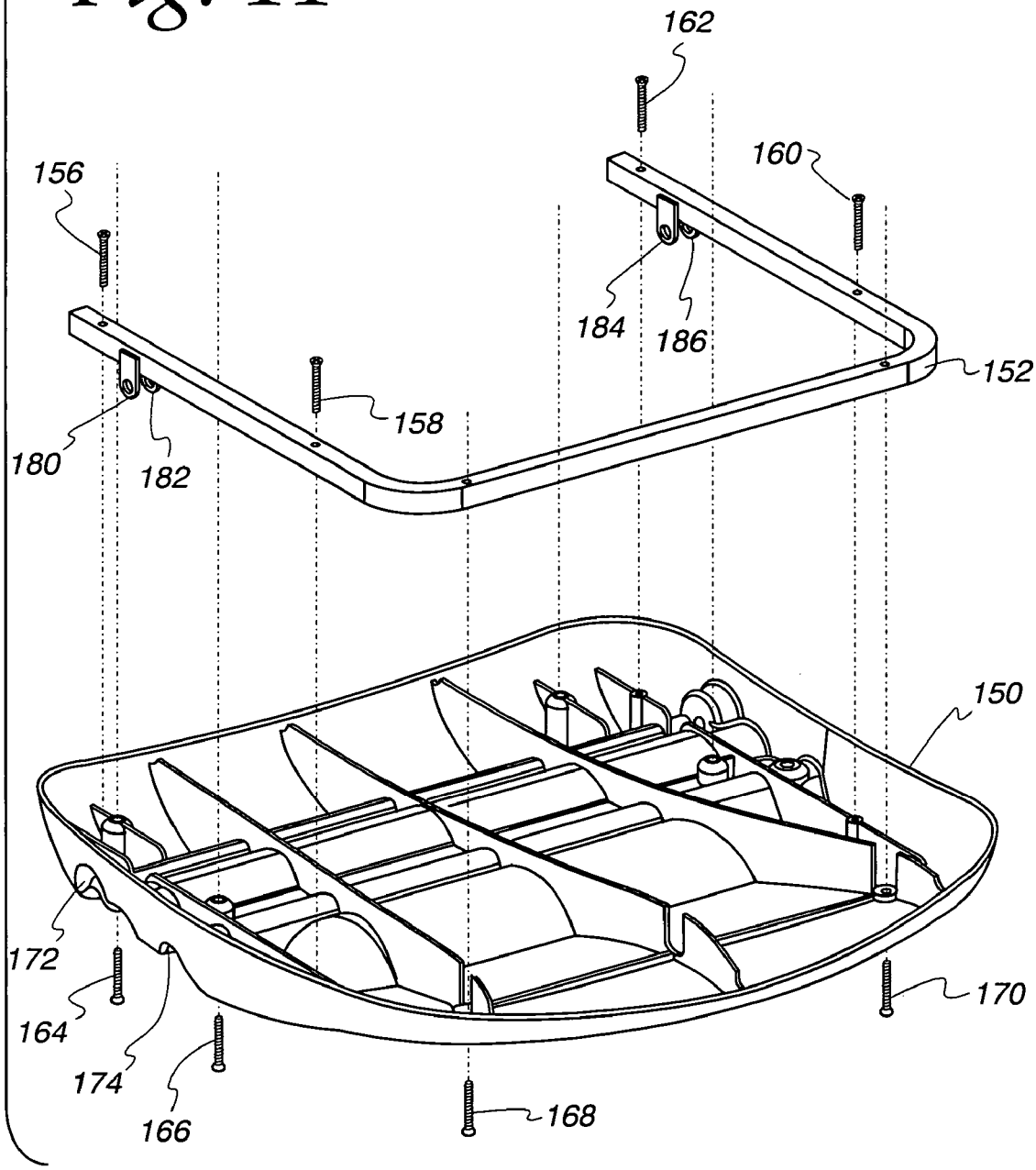
FIG. 11 is an enlarged, exploded isometric view of a portion of a seat assembly of the chair.

The seat assembly 22 includes a molded plastic pan 150, FIGS. 7 and 11, a U-shaped reinforcing tube 152 and a cushion 154. The reinforcing tube is connected to the pan using suitable fasteners, such as threaded screws 156, 158, 160, 162 and the cushion is connected to the pan using any suitable fasteners, such as threaded screws 164, 166, 168, 170.

Lateral recesses 172, 174 are formed in the seat pan to accommodate both the cross bar 44, and the middle portion 50 of the bent tube also forming the pair of rear legs 18, 20. The seat assembly is pivotally attached to the two eyelet brackets 54, 56 by the bolt 110 and fastener 116 along the first axis 57 by passing through openings in tube tabs 180, 182, 184, 186 attached to the U-shaped tube 152. This arrangement allows the seat assembly to also pivot around the first axis 57. While the back assembly pivots in response to a user's weight, the seat assembly rotates independently and is accomplished manually when the chairs are stored.

It is now appreciated that both the back assembly and the arms are connected against the bias of the springs to pivot around the first axis 57. The springs and related components are aligned along or parallel to the second axis 67. The seat assembly is also rotatable about the first axis 57 but it may move independent of movement of the back assembly and arms. All of these features are achieved with a relatively small number of components and in a simple manner so as to minimize expense.

The comfort of the chair is enhanced by the cushion, by the perforated back assembly and by the flexing and pivoting of the back assembly. The pivoting of the back assembly is accomplished by mounting a compression spring, a spring guide and a frame cap onto a rod. All of these elements are then mounted within each of the hollow tubular front legs. The top of each rod is threaded and engages with a corresponding dowel which are fixed in the side posts of the back assembly. In this way, the weight of a chair user may be used to recline the back assembly and thereby cause each rod to be pulled upwardly, compressing the corresponding spring between a spring guide and a frame cap.

The limit washer 104 includes a projection 190, FIG. 10, which pivots with the back assembly until the projection abuts the middle portion 50 of the tube forming the rear legs. Thus, the angular recline of the back assembly is limited. When a user sits upright, the back assembly will return to the position shown in FIGS. 1–6 under the biasing influence of the compression springs.

Figure 12:
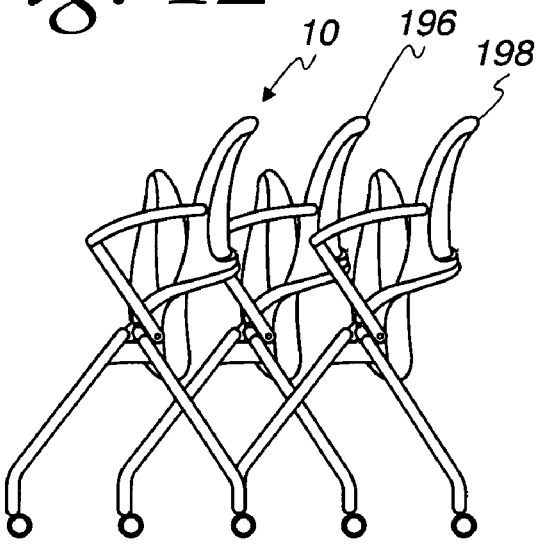
FIG. 12 is a left elevation view showing three copies of the chair shown in FIGS. 1–7 in a nested configuration.

Referring now to FIG. 12, the chair 10 is shown nested with two other identical or very similar chairs 196, 198 in a storage configuration. In this arrangement, the seat assembly of each chair is rotated from a generally horizontal disposition to a vertical one.

Figure 13:
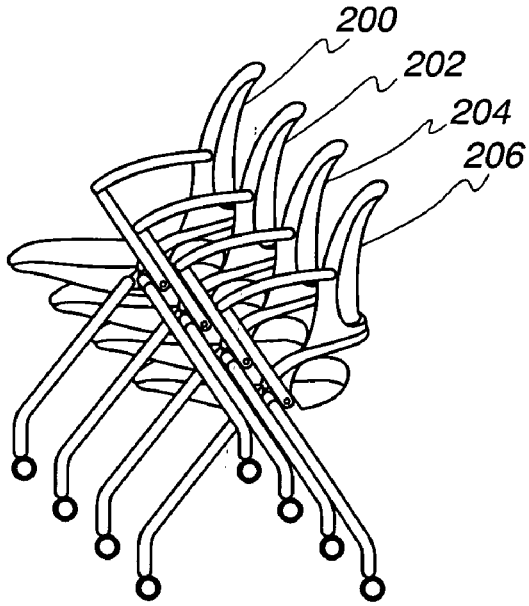
FIG. 13 is a left side elevation view of four copies of the chair shown in FIGS. 1–7 in a stacked configuration.

Referring now to FIG. 13, four chairs 200, 202, 204, 206 identical or very similar to the chair 10 are shown in a stacked position which may be used for storage and when moving the chairs from storage to a set up location. In a stack condition, the seat assemblies remain horizontal.

Figure 3:
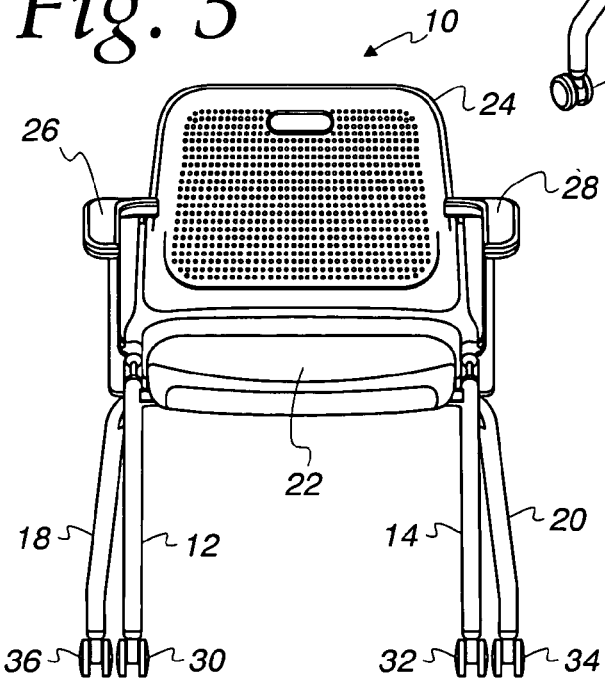
FIG. 3 is a front elevation view of the chair shown in FIGS. 1 and 2.
Figure 4:
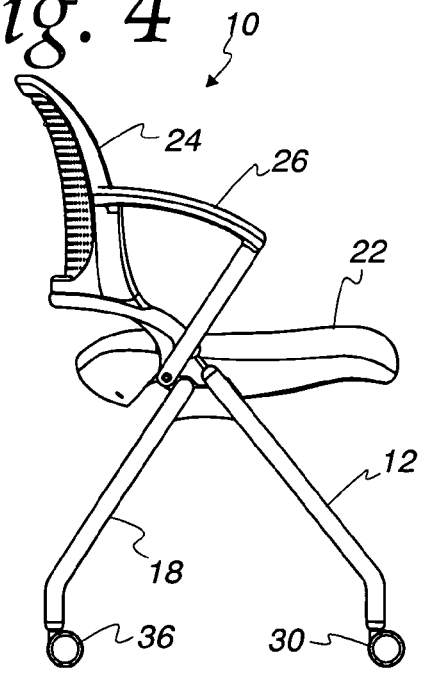
FIG. 4 is a right side elevation view of the chair shown in FIGS. 1–3.
Figure 5:
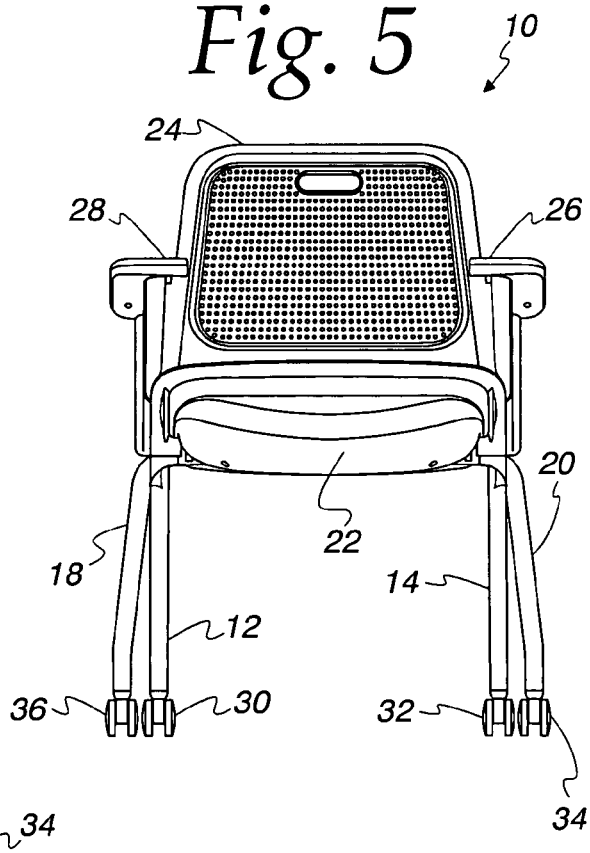
FIG. 5 is a rear elevation view of the chair shown in FIGS. 1–4.
Figure 6:
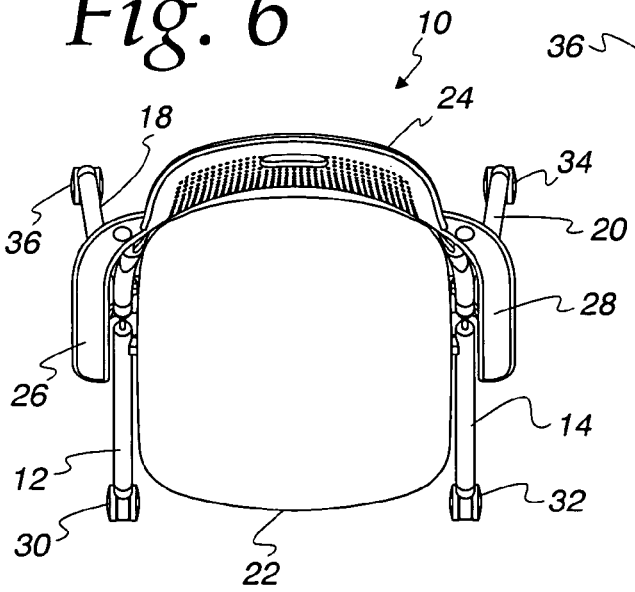
FIG. 6 is a top plan view of the chair shown in FIGS. 1–5.

To facilitate nesting and stacking, the front legs 12, 14 are more closely spaced apart than are the rear legs 18, 20. The distance between the front legs is less than the distance between the rear legs. This is shown in FIGS. 3, 5 and 6.

Figure 14:
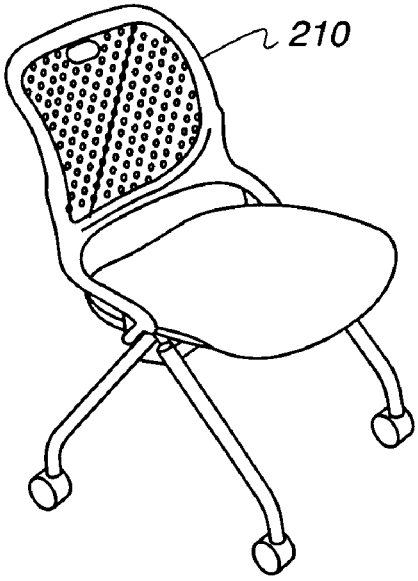
FIG. 14 is a front isometric view of an armless version of the chair shown in FIGS. 1–7.

Referring now to FIG. 14, the chair shown in FIGS. 1–6 is shown in an armless variation 210. Even though the arms are not present, the back assembly of the chair is pivotally mounted to recline around the first axis.

The above specification describes in detail the preferred embodiments of the present invention. Other examples, embodiments, modifications and variations will, under both the literal claim language and the doctrine of equivalents, come within the scope of the invention defined by the appended claims. For example, altering the shapes or designs of the back assembly, the seat assembly and/or the leg assembly will still result in equivalent structures. Further, they will come within the literal language of the claims. Still other alternatives will also be equivalent as will many new technologies. There is no desire or intention here to limit in any way the application of the doctrine of equivalents nor to limit or restrict the scope of the invention.

The invention claimed is:

1. A versatile chair comprising:

a leg assembly including a front pair of legs and a rear pair of legs connected to said front pair of legs;

a seat assembly mounted to said leg assembly;

a back assembly pivotally mounted to said leg assembly; a pair of biasing elements mounted within said front pair of legs and connected to said back assembly wherein said back assembly is pivotable while said seat assembly is stationary;

wherein said seat assembly is pivotable independently of said back assembly; and said seat assembly and said back assembly are pivotable about an identical axis.

2. The chair of claim 1 wherein: each leg of said front pair of legs is spaced from the other leg a smaller distance than the distance between the legs of said rear pair of legs.

3. The chair of claim 2 wherein: said leg assembly and said seat assembly are structured to allow said chair to be nested and stacked with chairs of identical structure.

4. The chair of claim 1 including: a pair of arms mounted to said back assembly and pivotable therewith.

5. The chair of claim 1 wherein: said leg assembly and said seat assembly are structured to allow said chair to be nested and stacked with chairs of identical structure.

6. The chair of claim 1 including: a caster attached to each leg of said leg assembly.

7. A versatile chair comprising: a leg assembly having a two front legs fixedly attached to two rear legs and structured to form an axis of rotation; a back assembly mounted to said leg assembly to rotate about said axis in response to shifting weight of a user; and a seat assembly mounted to said leg assembly to rotate about said axis independently from rotation of said back assembly, said seat assembly being manually rotatable from a generally horizontal position to a generally vertical position.

8. The chair of claim 7 wherein: said axis forming structure is a pair of brackets mounted to said leg assembly.

9. The chair of claim 8 wherein: said two front legs are connected by a bar.

10. The chair of claim 8 wherein: said two rear legs are portions of a bent tube, said tube having a middle portion for bridging the leg portions.

11. The chair of claim 10 wherein: said two front legs are connected by a bar.

12. The chair of claim 7 wherein: said two rear legs are portions of a bent tube, said tube having a middle portion for bridging the leg portions; and said axis forming structure is a pair of brackets mounted to said middle portion of said bent tube.

13. The chair of claim 7 wherein: said back assembly includes a back support and two side posts; and each of said side posts includes a hole for aligning with said axis of rotation.

14. The chair of claim 13 including; a fastener connected to each of said side posts and to said axis forming structure.

15. The chair of claim 14 wherein: said axis forming structure is a pair of brackets mounted to said leg assembly.

16. The chair of claim 13 including: a motion limiting washer mounted to engage said leg assembly after a predetermined rotation of said back assembly.

17. The chair of claim 7 wherein: said seat assembly includes projections having holes for aligning with said axis of rotation.

18. The chair of claim 17 including: a fastener connected to each of said projections and to said axis forming structure.

19. The chair of claim 18 wherein: said axis forming structure is a pair of brackets mounted to said leg assembly.

20. The chair of claim 19 wherein: said back assembly includes a back support and two side posts; and each of said side posts includes a hole for aligning with said axis of rotation.

21. The chair of claim 20 wherein; said fastener is connected to each of said side posts and to said pair of brackets.

22. A versatile chair comprising:

a leg assembly having a two front legs and two rear legs, said front legs each having an interior space; said leg assembly is structured to form an axis of rotation;

a seat assembly mounted to said leg assembly to rotate about said axis of rotation independently from rotation of said back assembly, said seat assembly being manually rotatable from a generally horizontal position to a generally vertical position;

a back assembly mounted to said leg assembly to rotate about said axis of rotation in response to shifting weight of a user; and a spring and connector components mounted in each front leg and being connected to said back assembly, said spring and connector aligned along a tension axis;

wherein said axis of rotation forming structure is a pair of brackets mounted to said leg assembly and said two rear legs are portions of a bent tube, said tube having a middle portion for bridging the leg portions; and said pair of brackets is mounted to said middle portion of said bent tube.

23. The chair of claim 22 wherein: said connector components include a rod, a spring guide and a frame cap.

24. The chair of claim 23 wherein: said frame cap is secured to a front leg of said leg assembly.

25. The chair of claim 24 wherein: said rod extends through said frame cap; and including a fastener mounted to said back assembly for engaging said rod.

26. The chair of claim 22 wherein: said back assembly includes a back support and two side posts; and each of said side posts includes a hole for aligning with said axis of rotation.

27. The chair of claim 26 including: a motion limiting washer mounted to engage said leg assembly after a predetermined rotation of said back assembly.

28. The chair of claim 27 wherein: said connector components include a rod, a spring guide and a frame cap; said frame cap is secured to a front leg of said leg assembly; said rod extends through said frame cap; and including a fastener mounted to said back assembly for engaging said rod.

29. A nestable and stackable chair comprising: a first horizontal axis; a back assembly pivotally mounted about said first axis; a seat assembly pivotally mounted about said first axis; a leg assembly including a front pair of legs; a rear pair of legs, said front and rear pairs of legs for supporting said back assembly and said seat assembly; a second axis aligned with said front pair of legs; and a pair of biasing elements aligned with said second axis, said pair of biasing elements being connected to said back assembly.

30. The chair of claim 29 including: a motion limiting washer mounted to engage said leg assembly after a predetermined rotation of said back assembly.

31. The chair of claim 30 wherein: said axis of rotation forming structure is a pair of brackets mounted to said leg assembly.

* * * * *